US005890616A

United States Patent [19]

Cravens et al.

[11] Patent Number: 5,890,616

[45] **Date of Patent: *Apr. 6, 1999**

[54] BULK CONTAINER WITH DISCHARGE COUPLING

[75] Inventors: James Cravens; Michael L. Dorsey, both of Madison; Roger Gregory, Naperville; John H. Reuman, Jr., Scottsburg, all of Ind.

[73] Assignee: Messe, Inc., Saddle Brook, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 794,228

[22] Filed: Jan. 30, 1997

[51] Int. Cl.[6] ..... B65D 21/02

[52] U.S. Cl. ..... 220/495.08; 220/23.86; 220/23.89

[58] Field of Search ..... 220/465, 403, 220/571, 495.08, 23.83, 23.86, 23.87, 23.89; 222/183, 185.1

[56] References Cited

U.S. PATENT DOCUMENTS

| | | | |
|---|---|---|---|
| 2,887,251 | 5/1959 | Mackridge | 222/185.1 |
| 3,368,721 | 2/1968 | Wiskochil | 222/183 |
| 4,164,304 | 8/1979 | Roberson | 220/465 |
| 4,934,654 | 6/1990 | Linnemann | 220/465 |
| 5,222,631 | 6/1993 | Hood | 222/185.1 |
| 5,395,014 | 3/1995 | Burrows | 222/185.1 |

*Primary Examiner*—Stephen Castellano

*Attorney, Agent, or Firm*—Fitzpatrick, Cella, Harper & Scinto

[57] ABSTRACT

A bulk container is provided with a detachable discharge coupling mounted to the container at a discharge port in a sump of the container. The discharge port is large enough to allow an operator to reach into the container to grasp a flexible liner that has been inserted into the container. The liner is equipped with a discharge fitment, which attaches to the discharge coupling. The apparatus of the present invention allows an operator to insert a flexible liner into a bulk container, attach said liner to the discharge coupling, and attach the discharge coupling to the container, without entering the container. Since the discharge coupling is inserted into the discharge port of the container from outside the container, it fits easily into the confines of a sump in the container.

4 Claims, 4 Drawing Sheets

BULK CONTAINER WITH DISCHARGE COUPLING

BACKGROUND OF THE INVENTION

This invention relates to a bulk container, a removable, disposable liner for the container, and means for attaching the liner to an output port on the bulk container.

The bulk container and liner are useful for storing and shipping materials that flow, such as fluids and pulverized solid materials. Such materials, such as fluid adhesives, paints and pulverized foodstuffs, flow out of the container and liner through an opening or port in the bulk container. Typically the materials flow out of the container under the influence of gravity.

Storage and shipment of fluids and pulverized solids can be accomplished using containers varying in size to several hundred gallons. Such containers can be made from a variety of materials. For example, 55 gallon drums constructed of steel have been used extensively. Also, larger bulk containers constructed of roto-molded polyethylene have been used.

Due to the expense of manufacturing and disposal of large containers, it is preferable to reuse the containers as often as possible. However, if material is stored directly inside the container, a number of problems arise. The container must be meticulously cleaned each time it is used in order to avoid contaminating the next batch of material to be stored in the container. Such cleaning may be difficult or even impossible to carry out, depending on the type of material used. Some materials, such as adhesives, may harden and bond to the interior of the container. Cleaning the containers can also prove to be costly, particularly if hazardous or toxic chemicals are used that must be disposed of in accordance with legislated disposal procedures.

In light of these problems, it is generally preferred to use a removable liner in a bulk container to act as a barrier between the stored material and the container wall. Liners can be made from a variety of materials which can be selected based on compatibility with the material to be stored. The liner, being generally made of a lightweight material, can be removed and disposed of after use without contaminating the container. A new liner can then be inserted into the container, and the container can be refilled, without the expensive and time-consuming process of cleaning the container. By using removable liners, a bulk container can be used many times with a large variety of stored materials, and without the need for expensive and time consuming cleaning between uses. This reduces the cost of the bulk container storage and shipment process.

A typical liner includes an inlet fitment (or an open top), and a discharge fitment. The discharge fitment of the liner is adapted to being connected to a discharge coupling on the container. For example, the fitment typically includes a threaded fitting which mates with a threaded fitting on the discharge coupling of the container. Prior art methods of inserting the liner into the container have required that an operator physically enter the container. For example, a bulk container is placed on its side so that a person can climb into the container. The person climbs into the container with a liner in hand, and attaches the discharge fitment of the liner to the discharge coupling on the container or holds it in place while another operator makes the attachment from the outside. The operator then climbs out of the container.

This method is problematic because it requires an operator to be agile, particularly if the container is small. More importantly, if the container previously has been used to store hazardous materials, there is a risk of exposure to such materials. In such a case, OSHA regulations require that specific time-consuming recording procedures be followed, which can significantly slow the process and add greatly to the cost. Accordingly, it is preferable to insert the liner without requiring an operator to enter the container.

A method and apparatus for inserting a liner without the entrance of a person into the container is disclosed in International Application No. PCT/US95/11917. Disclosed therein is a container with a discharge port (essentially a circular hole) in the lower part of one side wall of the container, near the bottom. Fitted to the container at the port is an "adapter assembly", in the form of a pipe with male threads on each end and a permanent flange.

An outlet fitment, which is bonded to a liner, is equipped with female threads and is screwed onto the upstream end of the adapter assembly. The adapter assembly is then inserted into the discharge port until the flange makes contact with the inside of the container wall. A nut is screwed onto the discharge end of the adapter assembly from outside the container, which secures the assembly to the container wall.

In order to guide the adapter assembly with liner attached into the discharge port, a rather complicated method and set of hardware must be used. A plug is screwed into the discharge end of the adapter assembly before it is dropped into the container. The plug has a lanyard attached to it with a magnet on the other end. The magnet is dropped into a "vertical guide tube" until it attaches, through magnetic attraction, to a "horizontal guide tube" which has been inserted into the discharge port so that one end is inside the container and the other is outside the container. The horizontal guide tube is then withdrawn from the container with the magnet (and in turn, the lanyard) attached. The vertical guide tube is then withdrawn and the operator must pull the plug with attached adapter assembly into the container and into the discharge port. Needless to say, this is a complicated process using a number of pieces of large, bulky hardware. In addition, given the fact that the long adapter assembly must be pulled out of a small discharge port from within the container without any guidance, the disclosed system does not allow for the use of a sump in the container, since the adapter assembly would get caught in the sump as it turned from a vertical position to a horizontal position to get into the discharge port. The use of a sump is preferred because it minimizes the amount of material that is left in the container after it is fully drained, thereby minimizing waste.

BRIEF SUMMARY OF THE INVENTION

It is thus an object of the present invention to provide an apparatus and method for inserting a liner into a bulk container without the entrance of a person into the interior of the container. It is a further object of the invention to provide a container with a detachable tubular discharge coupling that is adapted to be connected to an outlet fitment of a flexible liner. It is another object of the invention to provide a detachable discharge coupling with a flange of sufficient dimensions to fit over and seal a discharge port in a bulk container; said hole being large enough to allow insertion of a person's hand. It is another object of the invention to provide a detachable discharge port that is of sufficiently small length to allow it to be inserted into the confines of a sump in the bottom of a container.

To achieve the above objects, one aspect of the invention relates to a roto-molded bulk container having a sump in the lower portion thereof and a discharge port in the lowermost portion of the sump. The discharge port is large enough to allow the passage of a large hand and the tubular discharge fitments of commercially available liners. Surrounding the discharge port is a set of T-nuts which are integrally molded into the wall of the bulk container. The T-nuts are for the purposes of accepting bolts with which to attach the tubular discharge coupling to the bulk container.

Another aspect of the invention relates to a flexible liner for lining the bulk container. The liner has an open top or an inlet fitment and a discharge fitment. The discharge fitment is bonded to the liner and has threads for mating with the discharge coupling.

Another aspect of the present invention relates to a discharge coupling which is removably attached to the bulk container at the discharge port. The discharge coupling fits into the discharge port and has a proximal end which is inside the container and a distal end which is outside the container. The proximal end has threads which mate with threads on the discharge fitment of the flexible liner. The discharge coupling is also equipped with a flange for attaching the coupling to the container. The flange is larger than the discharge port and abuts against the outer surface of the wall of the container to form a seal therewith. The flange has holes to allow the passage of bolts which screw into the T-nuts in the container wall.

These and other objects and aspects of the present invention will be apparent from the drawings and the following description.

DETAILED DESCRIPTION OF THE PREFERRED EMBODIMENT

Figure 1:
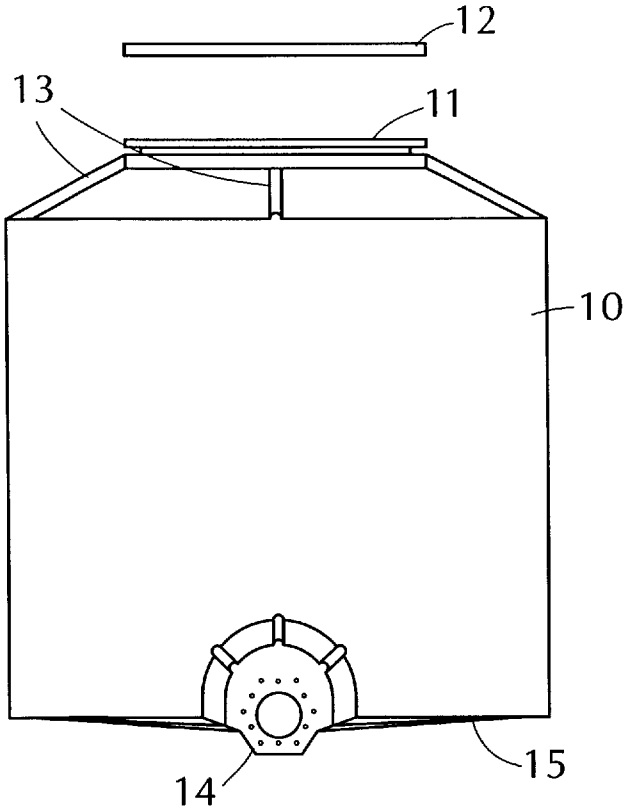
FIG. 1 is a front view of a bulk container of the present invention, without the discharge coupling installed.

Referring now to FIG. 1, a bulk container 10 is shown to which the present invention is applicable. Container 10 can be formed of any suitable durable material, such as plastic or steel. Preferably, the container is made of polyethylene. The polyethylene can be roto-molded into the desired shape in a manner known to those skilled in the art.

The top of the container has a circular opening 11 to accommodate a standard 55-gallon drum cover 12, or other suitable cover, which can be secured to the container with a standard lever lock ring (not shown) to form an airtight seal. Reinforcing ribs 13 are molded integrally into the top of the container 10 to add strength.

The bottom of container 10 has a sump 14 formed therein in the lowermost portion of the container, and bottom walls 15 are slightly sloped towards the sump so that liquid in the container will flow into the sump under the influence of gravity.

Figure 2:
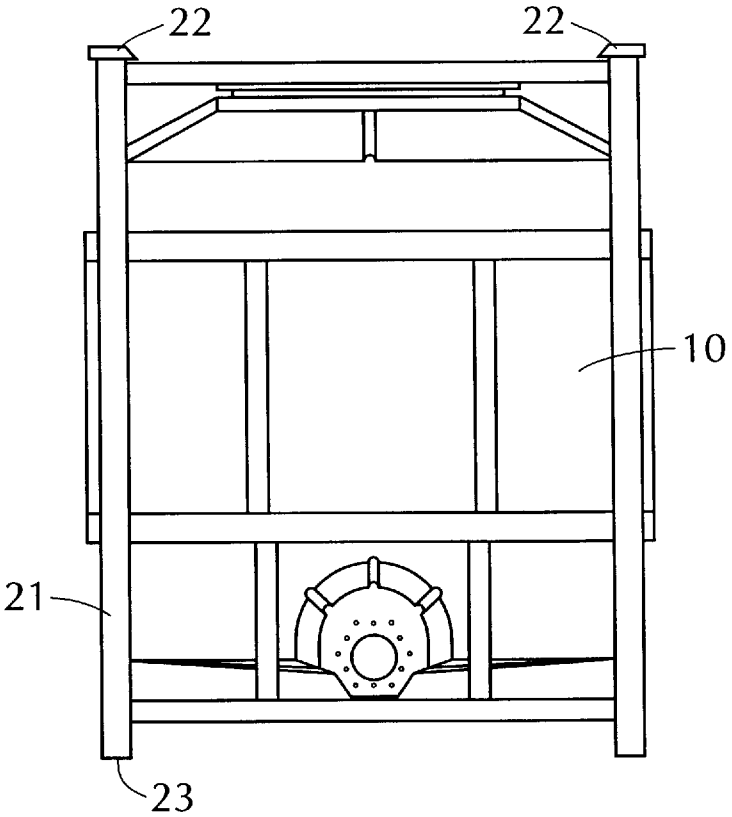
FIG. 2 is a front view of a bulk container of the present invention mounted in a stackable frame, without the coupling installed.

Referring to FIG. 2, bulk container 10 is shown mounted in a stacking frame 21. Stacking frame 21 is equipped with stacking pads 22 which accommodate the feet 23 of other frames so that the frames can be stacked for shipment or storage. The frames can be constructed of any suitable strong material, such as steel angle iron, in a manner that is well known to those skilled in the art. Alternatively, the bulk container 10 can be made with an integral palette that is molded into the container during the roto-molding process.

Figure 3:
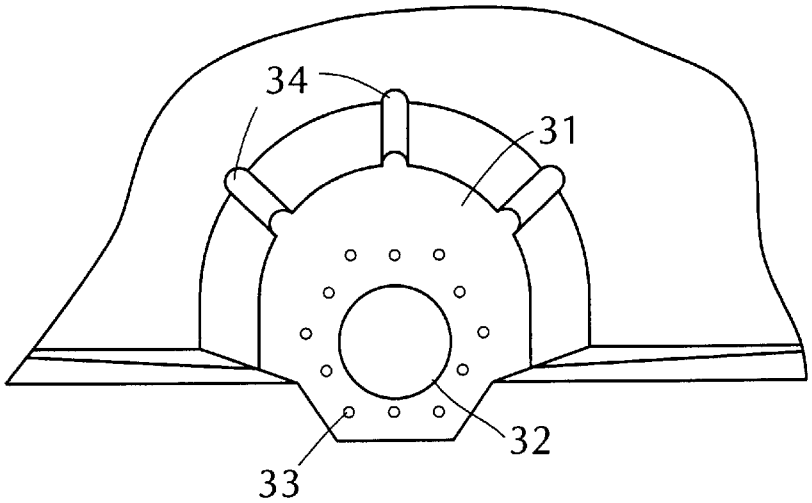
FIG. 3 is a front view of a bulk container of the present invention showing the sump.
Figure 5:
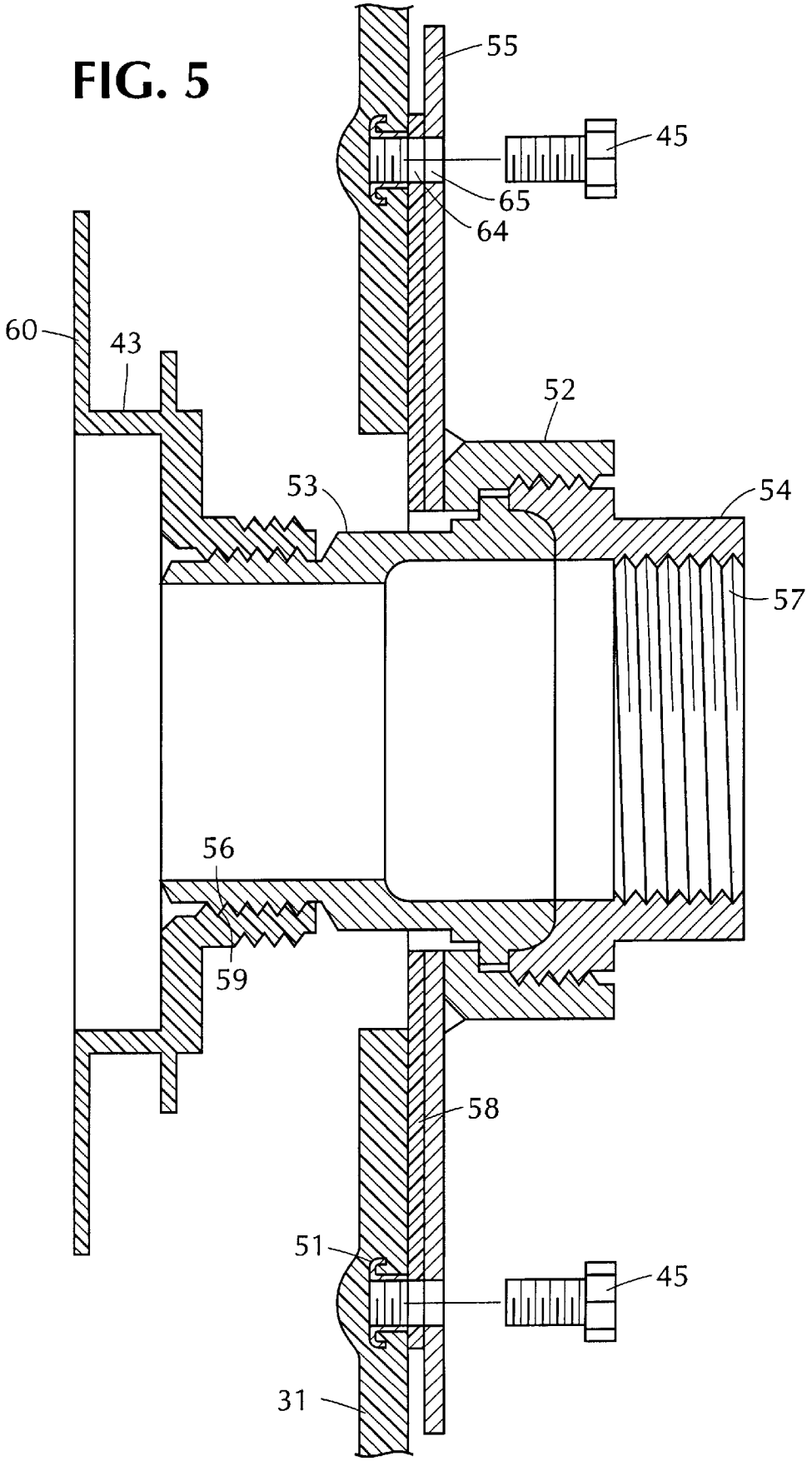
FIG. 5 is a cross-sectional view of the discharge coupling of the present invention attached to the container wall and having a discharge fitment of a liner attached.

Referring to FIGS. 1 and 3, the sump area 14 has a vertical wall 31 which has a discharge port 32. The discharge port 32 must be of suitable size to allow the passage of the hand of an operator. In the preferred embodiment the discharge port is 4 inches in diameter. Ribs 34 are integrally formed in the container walls to provide support around the sump 14. Positioned around the circumference of the discharge port is a set of fittings 33 for use in attaching the discharge coupling of the present invention to the container 10. In the preferred embodiment 5/16—18 T-nuts are used for this purpose. As shown in FIG. 5, the T-nuts 51 are molded into the vertical wall 31 of the sump 14 of the container 10. This is accomplished by placing the T-nuts in the mold during the roto-molding process, in a manner known to those skilled in the art.

Figure 4:
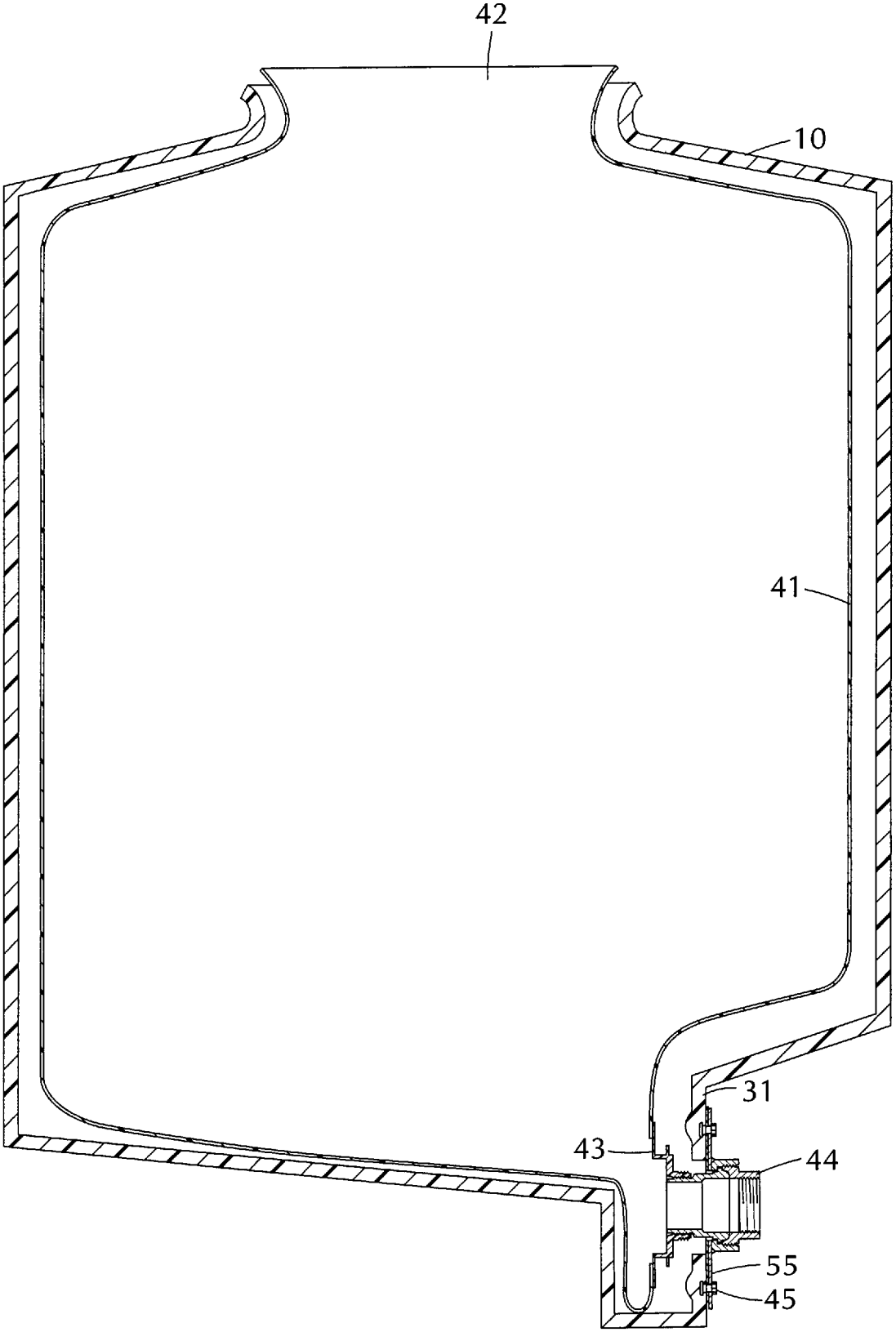
FIG. 4 is a cross-sectional view of a bulk container of the present invention, with a liner installed.

Referring to FIG. 4, the bulk container 10 of the present invention is shown pictorially in a cross-sectional view with a liner 41 installed. The liner is insertable into the container 10 through the opening 11 and includes an opening 42 for the insertion of the material to be stored. The liner also includes a discharge fitment 43 provided at the lower end thereof and bonded thereto. The liner can be made of any strong, flexible material so that it will assume the shape of bulk container 10 when filled with the material to be stored. The liner material can be selected for compatibility with the material to be stored, as discussed above. Liners suited for the purpose of this invention are commercially available. The liner discharge fitment 43 is removably attached to the discharge coupling 44. Discharge coupling 44 includes flange 55 which abuts the outer surface of vertical wall 31 of sump 14. The flange is secured to the bulk container 10 via bolts 45 which mate with T-nuts 51. When the apparatus is put together in the manner depicted in FIG. 4, material in the liner flows into the sump 14, out through the discharge fitment 43 of the liner, and then out through the discharge coupling 44.

A cross-sectional view of the discharge coupling of the preferred embodiment is shown in FIG. 5, with the discharge fitment 43 of the liner attached. In the preferred embodiment of the invention, the discharge coupling is fashioned from a standard union with a flange welded thereon. As is known to those skilled in the art, unions are commercially available in a variety of configurations. They can be purchased with male or female threads on one or both ends in any combination. In the preferred embodiment, a 2-inch union is used with male threads on the proximal end, which is the end that is inside the container 10 when the discharge coupling 44 is installed on the container. In the preferred embodiment, female threads are used on the distal end of the discharge coupling 44, to facilitate connection to a shut-off valve. It is to be understood that male or female threads can be used in any combination, and the choice of threads used in the preferred embodiment does not limit the scope of the invention. In the preferred embodiment, the threads of the union are national pipe threads ("NPT").

Thus, referring to FIG. 5, the union used in the discharge coupling 44 of the preferred embodiment is comprised of nut 52, a bevel male adapter 53 and a union nut 54. Bevel male adapter 53 is equipped with 2" male NPT threads 56, and union nut 54 is equipped with 2" female NPT threads 57.

The discharge coupling 44 of the preferred embodiment includes flange 55, which is welded to union nut 52. The discharge coupling can be made of any material suitable for pipe connections. In the preferred embodiment, stainless steel is used.

When the discharge coupling 44 is in place in the bulk container 10, it extends through the discharge port 32 of the bulk container. Flange 55 abuts the outer surface of vertical wall 31 of the sump 14 and is bolted thereto via bolts 45, which screw into the T-nuts 51. In the preferred embodiment, a gasket 58 is placed between the flange and the wall to provide a seal in the event that there is a leak in the liner. The gasket 58 can be made of any suitable material, such as an ethylene propylene monomer. Gasket 58 and flange 55 are equipped with a set of matching holes 64 and 65 to allow bolts 45 to pass through and screw into T-nuts 51.

As shown in FIG. 5, the discharge fitment 43 of the liner 41 screws onto the proximal end of the discharge coupling 44. In the preferred embodiment, discharge fitment 43 is equipped with female English threads 59, which provide an interference fit with the male NPT threads 56 of the discharge coupling 44. This ensures that a tight seal is made. In addition, pipe sealing tape, such as Teflon® tape, can be applied to the male threads 56 to provide a tight seal. Liner 41 is bonded to the discharge fitment 43 on the integrally molded flange 60 thereof.

Figure 6:
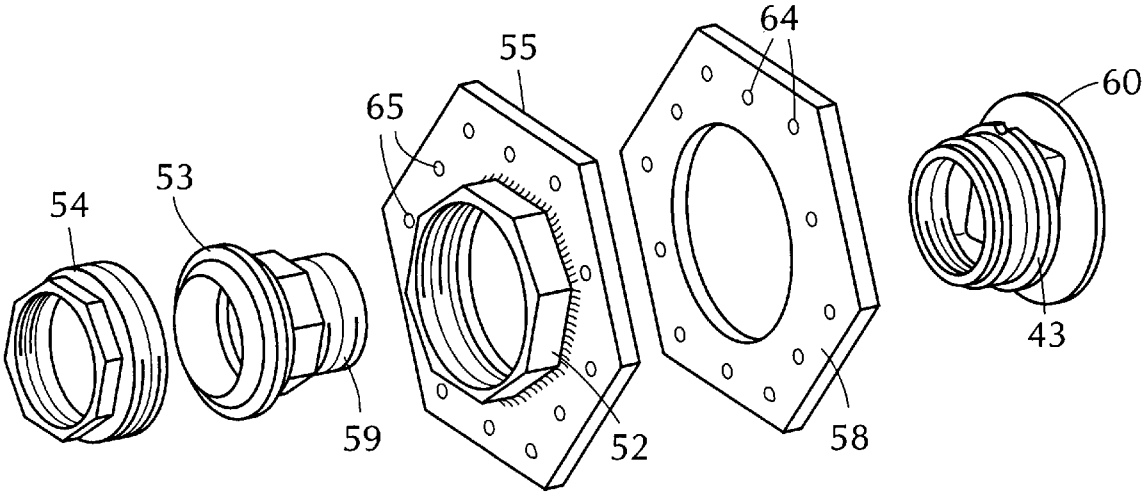
FIG. 6 is an exploded perspective view of the discharge coupling and discharge fitment of the present invention.

FIG. 6 shows an exploded perspective view of the preferred embodiment of the discharge coupling 44, gasket 58 and liner discharge fitment 43 of the present invention.

A method of inserting the flexible liner within the bulk container will now be described.

Initially, the top 12 of the container 10 is removed. The liner 41 with attached discharge fitment 43 is then fed into the container through the opening 11. The discharge fitment 43 and liner will be pulled to the bottom of the container into the vicinity of the sump 14 under the influence of gravity. The liner is fed completely into the container until the opening 42 of the liner is in the opening 11 of the container, and is held in that position. For example, the opening 42 of the liner can then be secured to the opening of the container 11 using a standard lever-lock ring.

The operator then inserts his hand into the container 10 through the discharge port 32 and pulls the fitment 43 out through discharge port 32. The operator does not need to pull the fitment 43 all the way through the port, but may do so if he chooses, since the discharge port 32 is sufficiently large to allow the passage of the fitment. The operator then places gasket 58 on the proximal side of the flange 55 and brings the proximal end of the discharge coupling 44 into contact with the discharge fitment 43. He then screws the fitment to the coupling until a seal is made. The operator may also apply pipe sealing tape to the male threads of the discharge coupling 44 before screwing it onto the fitment 43 to provide a tighter seal.

The proximal end of the discharge coupling 44 with attached discharge fitment 43 is then pushed into the container 10 through the discharge port 32 until the gasket 58 makes contact with the wall 31 of the container. The operator then lines up the holes 65 in flange 55 with the holes 64 in gasket 58 and the T-nuts 51, inserts the bolts 45 into the T-nuts 51, and tightens the bolts. In the preferred method an impact gun is used to tighten the bolts to a torque of approximately 35 foot-pounds. The container and liner are then ready to be filled with the material to be transported and/or stored.

The liner is removed from the container by reversing the method described above.

It should be understood that the preferred embodiment described herein is intended only in an illustrative, rather than a limiting sense. The true scope of the invention is set forth in the claims appended hereto.

What is claimed is:

1. A container for receiving a flexible liner, the liner having a discharge fitment with a threaded portion, said container comprising:

a walled vessel having a port formed in its wall, the port having a size sufficient to allow passage of the threaded portion of the discharge fitment therethrough; and a discharge coupling removably attached to an outer surface of said wall at said port, said discharge coupling comprising a tubular member having a proximal end and a distal end, the proximal end having a set of threads which project through the port in the vessel wall for engaging with the threads on the discharge fitment of the flexible liner; and a flange member, secured to said tubular member at its distal end, for abutting against said outer surface of said wall to form a removable seal therewith, wherein the part is sufficiently large to permit the threaded portion of the discharge fitment to be pulled through said port from outside said vessel to facilitate the engaging of the discharge fitment and said discharge coupling.

2. A container according to claim 1, further comprising means for attaching said flange member to said outer surface of said wall.

3. A lined container according to claim 1, further comprising a sump formed in a lower portion of said walled vessel, wherein said port is located in the sump.

4. A lined container according to claim 1, wherein said port is large enough to allow the passage of a human hand.

* * * * *

UNITED STATES PATENT AND TRADEMARK OFFICE

CERTIFICATE OF CORRECTION

PATENT NO. : 5,890,616
DATED : April 6, 1999
INVENTOR(S) : James Cravens et al.

It is certified that error appears in the above-identified patent and that said Letters Patent is hereby corrected as shown below:

Column 6,
Line 39, "part" should read -- port --.

Signed and Sealed this

Sixth Day of November, 2001

*Attest:*

Nicholas P. Godici

*Attesting Officer*

NICHOLAS P. GODICI
*Acting Director of the United States Patent and Trademark Office*